United States Patent [19]

Ballester

[11] Patent Number: 4,660,908

[45] Date of Patent: Apr. 28, 1987

[54] GROUNDING SADDLE

[75] Inventor: Hector G. Ballester, Anaheim Hills, Calif.

[73] Assignee: Ameron, Inc., Monterey Park, Calif.

[21] Appl. No.: 762,636

[22] Filed: Aug. 5, 1985

[51] Int. Cl.[4] ..... H01R 4/66

[52] U.S. Cl. ..... 339/14 R; 29/854; 339/14 L

[58] Field of Search ..... 339/14 R, 14 L, 251, 339/266 G, 275 R, 276 RB; 174/6, 78; 361/215, 220, 223, 224; 29/854

[56] References Cited

U.S. PATENT DOCUMENTS 3,370,122 2/1968 Ichikawa ..... 174/78

3,621,107 11/1971 Duven Dack ..... 174/6

FOREIGN PATENT DOCUMENTS 1151586 5/1969 United Kingdom ..... 339/14 L

*Primary Examiner*—Eugene F. Desmond

*Attorney, Agent, or Firm*—Christie, Parker & Hale

[57] ABSTRACT

A device is set forth for grounding a conduit or the like. The device includes a non-conductive saddle having an arcuate inner surface to mate with the exterior of the conduit. Secured along the inner surface is a mesh strap woven of conductive fibers. The saddle is adhered to the conduit with a conductive adhesive which conducts static charges from the conduit to the strap. Opposite the saddle the strap is conductively secured to a ground.

5 Claims, 5 Drawing Figures

Fig. 1
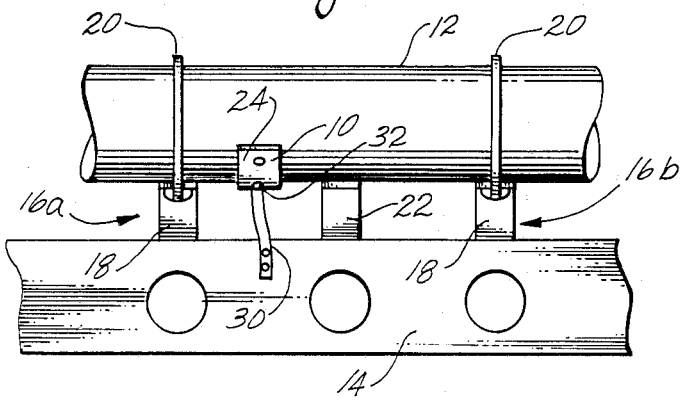
Fig. 2
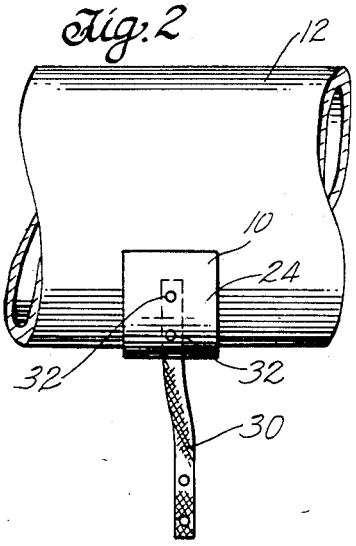
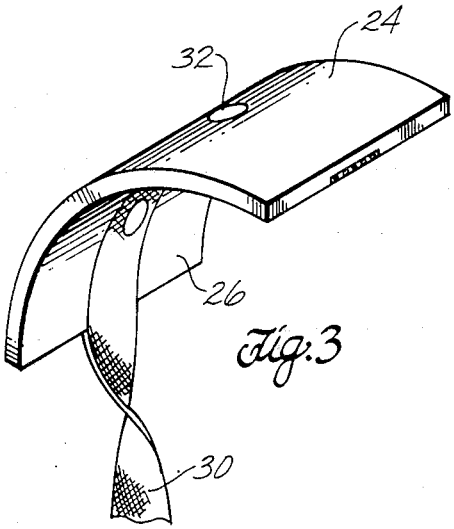
Fig. 3
Fig. 4
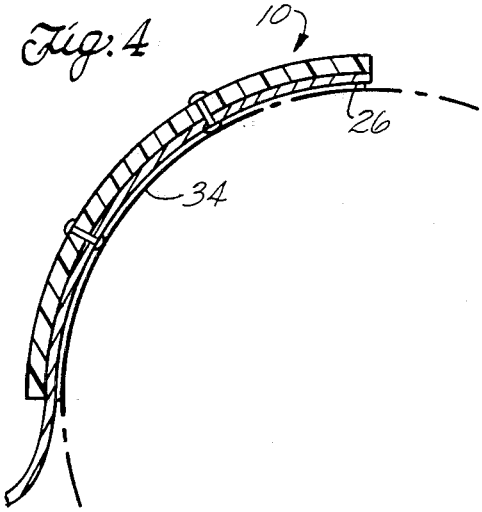
Fig. 5
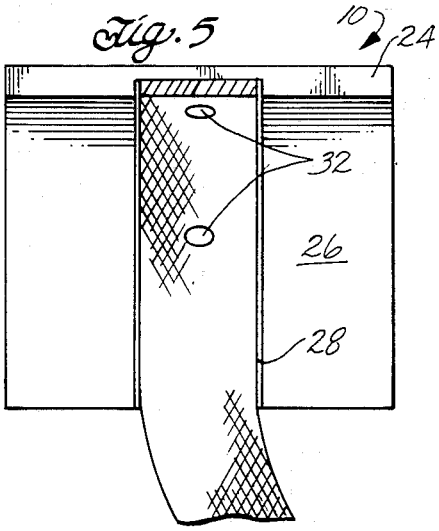

GROUNDING SADDLE

FIELD OF THE INVENTION

This invention relates to devices for grounding structures such as conduits.

BACKGROUND OF THE INVENTION

In non-ferrous structures such as aluminum, plastic, or fiberglass pipelines, static electrical charges can develop as fluid passes therethrough. These static charges, unless grounded, can build and eventually reach a potential at which the charge arcs from the pipeline to a nearby ground. Where flammable materials are present, such as at a refinery or onboard a tanker vessel, the electrical spark caused by arcing of the static charges can present a danger of explosion or fire.

Attempts have been made to ground conduits as exemplified in U.S. Pat. No. 2,956,103 issued Oct. 11, 1960 to Steel et al entitled "Pipe Support" and U.S. Pat. No. 4,428,104 issued Jan. 31, 1984 to Smith and entitled "Ground Clamp." In Steel et al, a non-conductive insert is brought into contact with the conduit at a pipe support, the insert transferring the static electrical charges in the conduit to a conductive plug and eventually to a pipe support bracket. In Smith, a metal saddle is attached to a conduit with a pipe band. The band also brings a conductive wire into contact with the saddle for conducting of static electrical charges to ground.

Either of these approaches is believed to be expensive from a manufacturing cost and labor and installation standpoint. Further, the approach as suggested in Steel et al limits the location at which the conduit can be grounded to the pipe supports which may be disadvantageous where long lengths of conduit extend between supports.

SUMMARY OF THE INVENTION

There is, therefore, provided in the practice of the present invention a grounding saddle which is inexpensive to manufacture and install and which can be used at conceivably any desired location along the structure or conduit to be grounded.

Toward this end, the device includes a non-conductive saddle having an inner surface to mate to the exterior surface of the structure to be grounded. For example, if the structure is a fiberglass conduit forming part of a pipeline, the saddle has an arcuate inner surface to closely mate with the exterior of the conduit. Secured along the saddle inner surface is a conductive member preferably embodied as a mesh strap or steel cable woven from conductive fibers such as copper, steel or the like. To accommodate the member, the saddle may be provided with a groove to receive the member in a somewhat recessed fashion along the inner surface. The member remote from the saddle is conductively attached to ground which may be the metallic superstructure for a vessel.

To attach the saddle and member to the conduit, a conductive adhesive is used to adhere the inner surface and conductive member to the exterior surface of the conduit. Accordingly, static electrical charges developed at the exterior surface of the conduit are conducted through the conductive adhesive and to the member and eventually to ground. As can be appreciated, the contact between the member and conduit is protected from the environment by the saddle and conductive adhesive which act to shield the contact from corrosive attack. Further, the device can be attached at any suitable location along the length of the conduit as desired. Additionally, it is believed that the grounding saddle according to the present invention is less costly to manufacture and install.

BRIEF DESCRIPTION OF THE DRAWINGS

These and other features and advantages of the present invention will become appreciated as the same become better understood with reference to the specification, claims and drawings wherein:

FIG. 1 is an elevation view of a conduit grounded with a device according to the present invention;

FIG. 2 is an enlarged elevation view of the attachment of the device to a conduit;

FIG. 3 is a perspective view of the device according to the present invention for grounding a conduit;

FIG. 4 is a section view of the device attached to a conduit shown in phantom; and FIG. 5 is an end view of the device according to the present invention.

DETAILED DESCRIPTION

Turning to the drawings, FIG. 1 shows a device 10 according to the present invention for grounding a structure illustrated as a conduit which may be a non-ferrous pipe 12 forming part of a pipeline. It is to be understood that while the following description is directed toward grounding a pipe to carry away static charges that the device according to the present invention can be used with any other structure where grounding is desired or required.

The pipe 12 is supported above a conductive and grounded beam 14 which may be part of, for example, a ship's superstructure, by pipe supports **16*a* and 16*b*. Each pipe support 16*a* and 16*b* includes a block 18 supported by the beam and a clamp 20. Clamp 20 passes around the pipe 12 and is adapted to secure the pipe 12 against the associated block 18. Intermediate blocks 22 may be positioned between the supports 16*a* and 16*b* to support the pipe 12**.

When the pipe 12 is carrying a fluid such as steam, compressed air, to name a few, static electrical charges may develop in the pipe 12. If the static electrical charges are not grounded they may achieve a potential where an electrical spark arcs from the pipe 12 to ground through, for example, the beam 14. As can be appreciated in certain applications, the presence of an electrical spark may be hazardous from a fire and explosion standpoint. Accordingly, means are required for grounding the pipe 12 to carry away the static electrical charges before they attain levels sufficient to produce arching.

To ground the pipe 12 one or more devices 10 are secured to the exterior of the pipe 12 as shown in FIGS. 1, 2 and 4 to provide a conductive pathway to carry away static electrical charges. The device 10 includes a saddle 24 having an inner surface 26 which is adapted to mate to the exterior of the pipe 12. Accordingly, as shown in FIGS. 3-5, the saddle 24 is fashioned as a cylindrical segment having an arcuate inner surface 26 with radius of curvature substantially identical to that of the exterior of the pipe 12. The saddle 24 is preferably fashioned from a non-conductive material such as plastic or fiberglass and may be simply fashioned by being cut from a suitable diameter conduit.

To provide a pathway to ground static electrical charges built up at the exterior of the pipe 12, the device 12 further includes a conductive member which may be a line consisting of a conductive cable or, preferably as shown in the drawings, a mesh strap 30 woven from conductive materials such as copper or steel wire. Strap 30 is secured to the saddle inner surface 26 by suitable means such as a pair of conductive rivets 32 which pass cooperatively through the strap 30 and saddle 24 to attach the strap 30 to the inner surface 26. To accommodate the strap 30 a groove 28 may be provided along the inner surface 26 so that the strap 30 lies substantially flush with the inner surface 26.

To attach the device 10 to the pipe 12, means are provided for conductively attaching the saddle 24 to the pipe 12. Preferably, these means are embodied as a conductive adhesive 34 disposed between the saddle 24 and the pipe 12 to conductively adhere the inner surface 26 to the pipe 12 as shown in FIG. 4. Accordingly, any static electrical charges present at the exterior surface of the pipe 12 are conducted through the adhesive 34 and to the strap 30. The strap 30, as shown in FIG. 1, is conductively secured to a grounded object such as the beam 14.

As can be appreciated, the device according to the present invention is simple to manufacture and to install to the pipe 12. Further, the device 10 may be installed at any suitable location or locations along the length of the pipe 12 as desired since it is not functionally restricted to use at the pipe supports.

While I have shown and described a certain embodiment of the present invention, it is to be understood that it is subject to many modifications without departing from the spirit and scope of the claims set forth herein.

What is claimed is:

1. A device for grounding a non-metallic conduit comprising:

a rigid non-conductive saddle having an arcuate inner surface to mate with a segment of the circumferential, cylindrical exterior of the conduit;

a grounded, conductive line fixed along the inner surface; and means for attaching the saddle inner surface and line to the conduit segment including a conductive adhesive, the conduit grounded through the adhesive and line.

2. The device of claim 1 wherein the saddle includes a groove along the inner surface to receive the line.

3. The device of claim 2 wherein the line is a conductive mesh strap, said groove adapted to receive the strap in a substantially flush relationship with the inner surface.

4. A method for grounding a non-metallic piping system comprising:

providing a rigid non-conductive saddle having an inner surface defined by a cylindrical segment adapted to closely mate with a segment of the outside surface of a pipe of the system;

securing a portion of a conductive metal strap at the inner surface, said strap adapted to be attached to a ground; and adhering the saddle inner surface and strap portion to the outside surface segment of the pipe with a conductive adhesive, electrical charges in the system grounded through the adhesive and strap.

5. The method of claim 4 wherein the saddle inner surface includes a groove, said securing step including securing said strap portion in said groove.

* * * * *